US009909082B2

(12) United States Patent
Jones et al.

(10) Patent No.: US 9,909,082 B2
(45) Date of Patent: Mar. 6, 2018

(54) LUBRICANT ADDITIVE BOOSTER SYSTEM

(71) Applicant: The Lubrizol Corporation, Wickliffe, OH (US)

(72) Inventors: Craig J. Jones, Wessington (GB); Thomas S. Derevjanik, Mentor-on-the-Lake, OH (US); Jack C. Kelley, Chagrin Falls, OH (US); Mark C. Davies, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/376,458

(22) PCT Filed: Feb. 12, 2013

(86) PCT No.: PCT/US2013/025669

§ 371 (c)(1),
(2) Date: Aug. 4, 2014

(87) PCT Pub. No.: WO2013/122898

PCT Pub. Date: Aug. 22, 2013

(65) Prior Publication Data

US 2015/0005210 A1 Jan. 1, 2015

Related U.S. Application Data

(60) Provisional application No. 61/599,509, filed on Feb. 16, 2012.

(51) Int. Cl.

| | |
|---|---|
| ***C10M 161/00*** | (2006.01) |
| ***C10M 169/04*** | (2006.01) |
| ***C10M 133/16*** | (2006.01) |
| ***C10M 167/00*** | (2006.01) |

(52) U.S. Cl.

CPC ..... *C10M 161/00* (2013.01); *C10M 167/00* (2013.01); *C10M 169/04* (2013.01); *C10M 2203/1006* (2013.01); *C10M 2203/1025* (2013.01); *C10M 2205/02* (2013.01); *C10M 2207/023* (2013.01); *C10M 2207/026* (2013.01); *C10M 2207/028* (2013.01); *C10M 2215/064* (2013.01); *C10M 2215/28* (2013.01); *C10M 2219/046* (2013.01); *C10N 2220/021* (2013.01); *C10N 2230/02* (2013.01); *C10N 2230/04* (2013.01); *C10N 2230/041* (2013.01); *C10N 2230/06* (2013.01); *C10N 2230/52* (2013.01); *C10N 2240/10* (2013.01); *C10N 2240/102* (2013.01)

(58) Field of Classification Search

CPC ..... C10M 161/00; C10M 167/00; C10M 169/04; C10M 2203/1006; C10M 2203/1025; C10M 2205/02; C10M 2207/023; C10M 2207/026; C10M 2207/028; C10M 2215/064; C10M 2215/28; C10M 2219/046; C10N 2220/021; C10N 2230/04; C10N 2230/041; C10N 2230/06; C10N 2230/52; C10N 2240/10; C10N 2240/102

See application file for complete search history.

(56) References Cited

U.S. PATENT DOCUMENTS

| | | | | |
|---|---|---|---|---|
| 7,615,521 | B2 * | 11/2009 | Eveland | C10M 129/42 508/228 |
| 7,928,045 | B2 * | 4/2011 | Dong | C10M 141/06 508/563 |
| 2008/0171678 | A1 * | 7/2008 | Loper | C10L 1/221 508/291 |
| 2009/0005278 | A1 * | 1/2009 | Takeuchi | C10M 141/06 508/371 |
| 2009/0011961 | A1 * | 1/2009 | Dong | C08K 5/13 508/149 |

FOREIGN PATENT DOCUMENTS

| | | | |
|---|---|---|---|
| EP | 1538193 | A1 | 6/2005 |
| EP | 1760138 | A2 | 3/2007 |
| EP | 1942177 | A2 | 7/2008 |
| WO | 2010099136 | A1 | 9/2010 |

* cited by examiner

*Primary Examiner* — James Goloboy

(74) *Attorney, Agent, or Firm* — Christopher P. Demas; Teresan W. Gilbert

(57) ABSTRACT

The disclosed technology relates to additive packages for lubricating compositions in diesel and gasoline powered vehicles. In particular, the disclosed technology provides an additive package that can be added to a lubricating composition with oil of lubricating viscosity to improve at least one of (A) piston deposit, (B) piston cleanliness, (C) soot induced viscosity thickening, and (D) oxidation induced viscosity thickening.

9 Claims, No Drawings

LUBRICANT ADDITIVE BOOSTER SYSTEM

BACKGROUND OF THE INVENTION

The disclosed technology relates to additive packages for lubricating compositions in diesel and gasoline powered vehicles. In particular, the disclosed technology provides an additive package that can be added to a lubricating composition with oil of lubricating viscosity to improve at least one of (A) piston deposits, (B) piston cleanliness, (C) soot induced viscosity thickening, and (D) oxidation induced viscosity thickening.

Historically it has been difficult to pass diesel soot induced viscosity thickening tests, diesel piston cleanliness tests and gasoline viscosity increase/gasoline piston deposit tests when using a group I/group III base oil mix in a lubricant composition for gasoline and diesel fueled engines.

Thus, a need exists for an additive package that can be included in a lubricant composition to improve at least one of the foregoing test results for gasoline and diesel fueled engines.

SUMMARY OF THE INVENTION

The disclosed technology addresses the foregoing deficiencies in the art. In one embodiment the invention is directed to an additive package comprising, (a) a dispersant mixture, (b) an antioxidant mixture and (c) a detergent. The dispersant mixture can comprise (i) the reaction products of a conventional polyolefin acylating agent and an aromatic amine, aliphatic amine, and mixtures thereof, and (ii) the reaction product of a high-vinylidene polyisobutylene acylating agent and an amine. The reaction products of (i) can contain at least 10 mol % of an aromatic amine. In addition, the polyolefin of (i) can have an Mn of at least about 1500 daltons and no more than 5,000 daltons. At least 50 mol % of the end groups in the polyisobutylene from which the polyisobutylene acylating agent of (ii) is derived can be methylvinylidene, and the polyisobutylene of (ii) can have an Mn of no more than 2500 daltons. The antioxidant mixture (b) of the additive package can comprise an ashless diarylamine, and an ashless phenol compound. The detergent of (c) can be an over-based phenol-containing detergent.

In one embodiment the dispersant of (a)(i) is a mixture of, (1) the reaction product of a succinated polyisobutylene with one or more polyethylenepolyamines, wherein the polyisobutylene has an average of between 1.2 and 1.6 succinic acid moieties per polymer and (2) the reaction product of succinated polyisobutylene with one or more aromatic polyamines wherein the polyisobutylene has an average of between 1.2 and 1.6 succinic acid moieties per polymer.

In another embodiment, the invention is directed to a lubricant composition comprising the foregoing additive package and an oil of lubricating viscosity.

One aspect of the invention relates to the lubricant composition passing test PSA DV4 for soot induced viscosity thickening and piston cleanliness in a PAS1 4 liter, 8 valve 4 cylinder diesel engine.

A further aspect relates to the lubricant composition passing test VW TDI for piston cleanliness in a 4 cylinder 1.9 liter, 81 kW passenger car diesel engine.

In another aspect of the invention, the lubricant composition can pass the Sequence IIIG test for oxidation induced viscosity thickening and piston cleanliness in a GM 3.8 liter 6 valve gasoline engine.

Thus, in another embodiment of the invention, there is provided a method of lubricating an engine comprising applying to the engine a lubricating composition as described herein.

DETAILED DESCRIPTION OF THE INVENTION

Various preferred features and embodiments will be described below by way of non-limiting illustration.

In one embodiment, the invention provides an additive package comprising a dispersant mixture, an ashless antioxidant mixture and an over-based phenol-containing detergent.

Dispersant Mixture

The additive package may include a dispersant mixture comprising (i) the reaction products of a conventional polyolefin acylating agent and an aromatic amine, aliphatic amine, or mixtures thereof, and (ii) the reaction product of a high-vinylidene polyisobutylene acylating agent and an amine, preferably a polyamine.

Acylating agents are compounds that can provide an acyl group in an acylation reaction. Typical examples of acylating agents are, for example, succinic acid, maleic acid, itaconic acid, fumaric acid, cinnamic acid, reactive equivalents and derivatives thereof.

The acylating agent may be a polyolefin acylating agent prepared from a conventional polyolefin. Conventional polyolefins are derived from polymerized $C_2$-$C_6$ mono olefins. The polymers may be homopolymers, copolymer or interpolymers. The preferred polyolefin is polyisobutylene (PIB) formed by polymerizing the $C_4$-raffinate of a cat cracker or ethylene plant butane/butene stream using aluminum chloride or other acid catalyst systems.

The polyolefin made in this manner is termed a conventional polyisobutylene (PIB) and is characterized by having unsaturated end groups shown in Table 1 with estimates of their mole percents based on moles of polyisobutylenes. The structures are as shown in EPO 355 895. Conventional PIBs are available commercially under numerous trade names including Parapol® from Exxon and Lubrizol® 3104 from Lubrizol.

TABLE 1

| PIB Terminal Groups | (a) Typical Percent in Conventional PIB | (b) Typical Percent in High Vinylidene PIB |
|---|---|---|
| 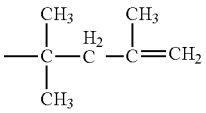 I | 4-5% | 50-90% |
| 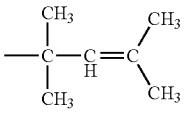 II | 0-2% | 6-35% |
| 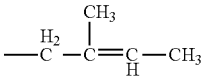 III | 63-67% tri-substituted | absent or minor |

TABLE 1-continued

| PIB Terminal Groups | (a) Typical Percent in Conventional PIB | (b) Typical Percent in High Vinylidene PIB |
|---|---|---|
| 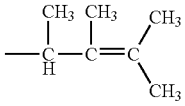 IV | 22-28% tetrasubstituted | 1-15% |
| 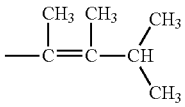 IV | IV and IVa | |
| 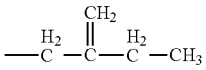 V | 5-8% | 0-4% |
| OTHER | 0-10% | |

The number average molecular weight (Mn) range of the polyolefins is from about 300-10,000 or even up to 50,000. However, for instance, the preferred range for polyisobutylenes is Mn of about 300-5,000 and the most preferred upper limit Mn is in the range of about Mn 300-2,500. In general, the polyolefin may be prepared from polymerisable monomers containing about 2 to about 16, or about 2 to about 8, or about 2 to about 6 carbon atoms. Often the polymerisable monomers comprise one or more of propylene, isobutene, 1-butene, isoprene, 1,3-butadiene, or mixtures thereof.

The reaction products of a conventional polyolefin acylating agent and an aromatic amine, aliphatic amine, or mixtures thereof, can encompass both mixtures of aromatic containing and aliphatic containing conventional polyolefin acylating agents and a mixture of conventional polyolefin acylating agents wherein single agents contain either one or a mixture of aromatic and aliphatic amines.

As used herein, the term "aliphatic amine" refers to a molecule containing nitrogen in which none of the nitrogens are aromatic. The aliphatic amine may be an aliphatic polyamine such as ethylene polyamine (i.e., a poly(ethyleneamine)), a propylene polyamine, a butylene polyamine, or a mixture of two or more thereof. The aliphatic polyamine may be ethylene polyamine. The aliphatic polyamine may be selected from ethylenediamine, diethyllenetriamine, triethylenetetramine, tetraethylenepentamine, pentaethylenehexamine, polyamine still bottoms, or a mixture of two or more thereof.

The reaction products of (i) with aliphatic amines may be succinimide dispersants, succinamide dispersants, succinic acids, amides, or ester-amides, or mixtures thereof.

The reaction products of (i) with aliphatic amines may also be polyolefin succinic acid esters, amides, or ester-amides. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a polyamine, typically diethylenetriamine, polyamine still bottoms, tetraethylenepentamine (TEPA), and the like).

Additionally, the reaction products of (i) with aliphatic amines may be N-substituted long chain alkenyl succinimides. An example of an N-substituted long chain alkenyl succinimide is polyisobutylene succinimide, that is, a polyisobutene substituted succinimide dispersant.

Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The reaction products of (i) may contain aromatic amines. As used herein, the term "aromatic amine" refers to a molecule containing at least one aromatic nitrogen. In one embodiment, an aromatic nitrogen is a nitrogen either within an aromatic ring or directly bonded to an aromatic ring. In another embodiment, aromatic nitrogen refers only to nitrogen directly bonded to an aromatic ring.

Aromatic amines may have one or more aromatic moieties linked by a hydrocarbylene group and/or a heteroatom such as N-phenyl-1,4-phenylenediamine (4-amino diphenylamine). The aromatic amine may be a nitro-substituted aromatic amine. Examples of nitro-substituted aromatic amines may include 2-nitroaniline, 3-nitroaniline, and 4-nitroaniline. 3-nitroaniline may be particularly useful. Other aromatic amines may be present along with the nitroaniline. Condensation products with nitroaniline and optionally also with Disperse Orange 3 (that is, 4-(4-nitrophenylazo)aniline) are disclosed in U.S. Patent Publication 2006/0025316.

The amine may be an amine having at least 2, or at least 3, or at least 4 aromatic groups, for instance, from about 4 to about 10, or from about 4 to about 8, or from about 4 to about 6 aromatic groups, and at least one primary or secondary amino group or, alternatively, at least one secondary amino group. The amine may comprise both a primary and at least one secondary amino group. The amine may comprise at least about 4 aromatic groups and at least 2 of any combination of secondary or tertiary amino groups.

An example of an amine having 2 aromatic groups is N-phenyl-pphenylenediamine. An example of an amine having at least 3 or 4 aromatic groups may be represented by Formula (I):

Formula 1

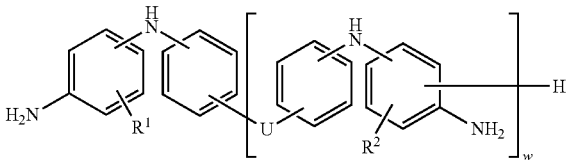

wherein, independently, each variable is as follows: $R^1$ may be hydrogen or a $C_{1-5}$ alkyl group (typically hydrogen); $R^2$ may be hydrogen or a $C_{1-5}$ alkyl group (typically hydrogen); U may be an aliphatic, alicyclic or aromatic group (when U is aliphatic, the aliphatic group may be a linear or branched alkylene group containing 1 to about 5, or 1 to about 2 carbon atoms); and w may be from 1 to about 10, or 1 to about 4, or 1 to 2 (typically 1). When U is an aliphatic group, U may be an alkylene group containing 1 to about 5 carbon atoms. Alternatively, the amine may also be represented by Formula (Ia)

Formula (1a)

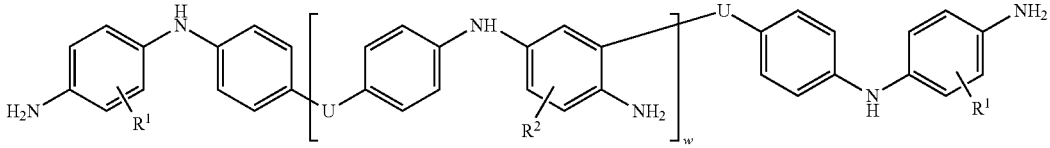

wherein each variable U, $R^1$, and $R^2$ are the same as described above and w is 0 to about 9, or 0 to about 3, or 0 to about 1 (typically 0).

Further aromatic amines suitable to be employed in the reaction products of (i) can be found in U.S. Pat. No. 7,253,231 to Devlin at al., issued Aug. 7, 2007, the content of which are incorporated herein by reference.

In one embodiment, at least 10 mol % of the reaction products of (i) can contain an aromatic amine. In another embodiment, at least 10 mol % but not more than 60 mol % of the reaction products of (i) can contain an aromatic amine. Preferably, at least 15 mol % but no more than 50 mol % can contain an aromatic amine, and most preferably at least 20 mol % and no more than 40 mol % contain an aromatic amine. In another embodiment, greater than 30 mol % of the reaction products of (i) can contain an aromatic amine, or from 30 mol % to about 80 mol %, or 40 mol % to about 95 mol %. In one example, the dispersant mixture may comprise a mixture of (1) the reaction product of a succinated polyisobutylene with one or more polyethylenepolyamines, wherein the polyisobutylene has an average of between 1.2 and 1.6 succinic acid moieties per polymer, and (2) the reaction product of succinated polyisobutylene with one or more aromatic polyamines, such as, for example, 4-amino diphenylamine, wherein the polyisobutylene has an average of between 1.2 and 1.6 succinic acid moieties per polymer.

In a further embodiment, at least 3% of the nitrogen from the amines in the reaction products of (i) can be aromatic nitrogen. Alternately, at least 10%, or at least 15%, or at least 20% of the nitrogen from the amines in the reaction products of (i) can be aromatic nitrogen. In another embodiment, at least 3% but not more than 60% of the nitrogen from the amines in the reaction products of (i) can be aromatic nitrogen. Preferably, at least 4% but not more than 55% of the nitrogen from the amines in the reaction products of (i) can be aromatic nitrogen, and most preferably at least 5% and no more than 50 mol % can be aromatic nitrogen.

The dispersants of (i) may be present in the lubricant composition at a concentration in the range from about 0.01 wt % to about 20 wt %, or from about 0.1 wt % to about 15 wt %, or from about 0.1 wt % to about 10 wt %, or from about 1 wt % to about 6 wt %, or from about 1 to about 3 wt % of the lubricating composition. Preferably the dispersant of (i) is present at about 2.0, or 2.5, or 3.0 wt %.

The high vinylidene polyisobutylene acylating agent of (ii) can be derived from a high vinylidene polyisobutylene having a number average molecular weight (Mn) of no more than about 2500 daltons, or no more than 2000 daltons or 1800 daltons, and in one embodiment no more than 1500 daltons or 1250 daltons. The high vinylidene polyisobutylene acylating agent is reacted with an amine, preferably a polyamine, and preferably an aliphatic polyamine. The aliphatic amine may be an aliphatic polyamine such as ethylene polyamine (i.e., a poly(ethyleneamine)), a propylene polyamine, a butylene polyamine, or a mixture of two or more thereof. The aliphatic polyamine may be ethylene polyamine. The aliphatic polyamine may be selected from ethylenediamine, diethylenetriamine, triethylenetetramine, tetraethylenepentamine, pentaethylenehexamine, polyamine still bottoms, or a mixture of two or more thereof.

As shown in Table 1, a high vinylidene PIB can be characterized as having a major amount, typically more than 50 mol % of an alpha-vinylidene, often referred to as methylvinylidene, and/or beta-double bond isomer (respectively $—CH_2C(CH_3)=CH_2$ and/or $—CH=C(CH_3)_2$), and minor amounts of other isomers including a tetrasubstituted double bond isomer. Because of their high vinylidene double bond isomer content, high vinylidene PIBs are considered to be more reactive and to undergo a higher conversion to derivatives which are better performers in comparison to derivatives from conventional PIBs. High vinylidene PIBs generally can contain greater than about 50 mole %, 60 mole %, or 70 mole % or greater and usually about 80 mole % or greater or 90 mole % or greater of alpha-vinylidene and/or beta-double bond isomer and about 1 to 10 mole % of tetrasubstituted double bond isomer. In an embodiment of the invention the high vinylidene PIB has an alpha- and/or beta-vinylidene double bond isomer content of 55 mole % or greater, and in other embodiments has an alpha-vinylidene and/or beta-double bond isomer content of 65, of 75, or of 85 mole % or greater. High vinylidene PIBs are prepared by polymerizing isobutylene or an isobutylene containing composition with a milder acidic polymerization catalyst such as $BF_3$. High vinylidene PIBs are available commercially from several producers including BASF and Texas Petroleum Chemicals.

In such an embodiment where the polyolefin is a high vinylidene polyolefin, the polyolefin can have an average of between about 0.5 and 1.0 acylating agent moieties per polymer. For example, the dispersant mixture may comprise a PIB-succinimide wherein the PIB from which the PIB-succinimide is derived contains at least 50 mol % methylvinylidene terminated molecules.

The dispersants of (ii) may be present in the lubricant composition at a concentration in the range from about 0.01 wt % to about 20 wt %, or from about 0.1 wt % to about 15 wt %, or from about 2.0 wt % to about 10 wt %, or from about 1 wt % to about 6 wt %, or from about 1 to about 3 wt % of the lubricating composition. Preferably the dispersant of (i) is present at about 0.5, or 1.0, or 1.5 wt %.

In one embodiment, the at least 0.1% of the nitrogen from the amines in the dispersant mixture of (a) can be aromatic nitrogen. Alternately, at least 5%, or at least 10%, or at least 15% of the nitrogen from the amines in the dispersant mixture of (a) can be aromatic nitrogen. In another embodiment, at least 0.5% but not more than 60% of the nitrogen from the amines in the dispersant mixture of (a) can be aromatic nitrogen. Preferably, at least 1% but not more than 55% of the nitrogen from the amines in the dispersant mixture of (a) can be aromatic nitrogen, and most preferably at least 1.5% and no more than 50 mol % aromatic nitrogen.

The dispersants of (i) and (ii) may be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. The post-treated dispersant may be borated. The dispersants herein may also be free of boron. The post-treated dispersant may result from a reaction of the dispersant with a dimercaptothiadiazole. The post-treated dispersant may result from a reaction of the dispersant with phosphoric or phosphorous acid.

If the dispersant contains basic nitrogen atoms, such basicity may be measured as TBN of the dispersant. In one embodiment, the TBN of a useful succinimide dispersant may be about 10 to about 30 on an oil-free (corrected) basis, which would correspond to about 5 to about 15 if measured on a dispersant sample containing 50 wt % oil.

Ashless Antioxidant Mixture

Antioxidants comprise a wide class of well-known materials, notably including alkyl-substituted hindered phenols and aromatic amines. It is preferred that the antioxidant of the present compositions is at least one alkyl-substituted hindered phenol or at least one aromatic amine, or preferably a mixture of these types. The ashless antioxidant mixture can be present from about 0.01 to about 10 wt %, or from about 0.1 to about 8 wt % or from about 1.0 to about 6 wt %.

Hindered phenols are generally alkyl phenols of the formula

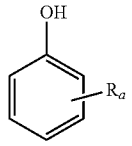

wherein each R is independently an alkyl group containing from 1 up to about 24 carbon atoms and a is an integer of from 1 up to 5. Preferably R contains from 4 to 18 carbon atoms and most preferably from 4 to 12 carbon atoms. R may be either straight chained or branched chained; branched chained is preferred. The preferred value for a is an integer of from 1 to 4 and most preferred is from 1 to 3. An especially preferred value for a is 2.

The hindered phenolic antioxidant is preferably an alkyl phenol; however, mixtures of alkyl phenols may be employed. Preferably the phenol is a butyl substituted phenol containing 2 or 3 t-butyl groups. When a is 2, the t-butyl groups normally occupy the 2,6-position, that is, the phenol is sterically hindered:

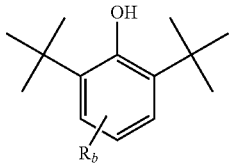

where b is 0 to 3. When a is 3, the t-butyl groups normally occupy the 2,4,6-position. Other substituents are permitted on the aromatic ring. Examples of phenolic antioxidants include 2,6-di-t-butyl-p-cresol (i.e., 2,6-di-t-butyl-4-methylphenol) and other para alkyl substituted di-t-butyl phenols, where the para alkyl group contains 9 to 18 carbon atoms. In one embodiment the alkyl group contains 12 carbon atoms and can be seen as a propylene tetramer. The para alkyl group may also be substituted with nitrogen or oxygen groups, such as, for example, an amide or ester group. For example, the para alkyl group may be carboxy ethyl or an alkylester thereof such as shown in the formula:

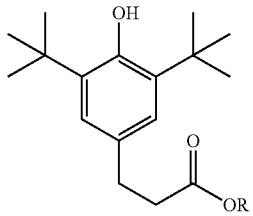

where R can be H or an alkyl group of about 1 to 30, or 5 to 25, or 10 to 20 carbons. These and other hindered phenolic antioxidants and their methods of preparation are well known to those skilled in the art; such antioxidants are commercially available. Related materials include sulfur-bridged alkyl-substituted phenolic antioxidants; such materials may also be at least partially neutralized with a metal salt. In one embodiment a para-alkyl-substituted hindered phenol antioxidant is present in an amount of greater than about 0.5 wt % of the composition.

Aromatic amine antioxidants include aromatic amines of the formula:

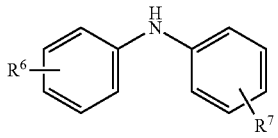

wherein $R^6$ and $R^7$ are independently a hydrogen or an alkyl group containing from 1 up to 24 carbon atoms. Preferably $R^6$ and $R^7$ are alkyl groups containing from 4 up to about 20 carbon atoms, and may be linear, cyclic or aromatic. For example, the above formula can encompass alkylated phenyl naphthyl amines.

A particularly useful amine antioxidant can be an alkylated diphenylamine, which diphenylamine can be monoalkylated (one of $R^6$ and $R^7$ is H and one is an alkyl), as shown, or dialkylated (both $R^6$ and $R^7$ are alkyl), or mixtures thereof, wherein $R^6$ and $R^7$ are both nonylated, or $R^6$ and $R^7$ are octylated/butylated. Another useful amine antioxidant can be phenyl-α-naphthylamine (PANA) or alkylated phenyl-α-naphthylamine (APANA).

Aromatic amine antioxidants and their preparation are well known to those skilled in the art. These materials are commercially available and are supplied, for example, as Naugard™ 4386 by Uniroyal Chemical. Such a diarylamine antioxidant is preferably present in an amount greater than 1.0 wt % of the composition.

Detergents

The additive composition can comprise a detergent, such as an over-based phenol-containing detergent. Phenol-containing detergents can be selected from phenates, salicylates, saligenins, and salixarates. In one embodiment, the over-based phenol-containing detergent can be a phenate detergent.

Overbased detergents contain a metal. The metal of the over-based detergent may be zinc, sodium, calcium, barium, or magnesium. Typically the metal of the metal-containing detergent may be sodium, calcium, or magnesium.

The overbased metal-containing detergent may be selected from overbased phenol-containing detergents selected from the group consisting of non-sulfur containing phenates, sulfur containing phenates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, for example, phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a hybrid sulfonate/phenate detergent may be employed, the hybrid detergent would be considered equivalent to amounts of distinct phenate and sulfonate detergents introducing like amounts of phenate and sulfonate soaps, respectively.

Typically an overbased detergent may be a zinc, sodium, calcium or magnesium salt of a phenate, sulfur containing phenate, sulfonate, salixarate or salicylate. Overbased salixarates, phenates and salicylates typically have a total base number of 180 to 450 TBN. Overbased sulfonates typically have a total base number of 250 to 600, or 300 to 500. The term "TBN" refers to total base number. This is the amount of acid (perchloric or hydrochloric) needed to neutralize all or part of a material's basicity, expressed as milligrams of KOH per gram of sample. An amount of overbased detergent may be provided such that the final lubricant composition has an initial TBN of more than about 5 but less than about 20, or more than about 6 but less than about 18, and preferably more than about 8 but less than about 15.

Other overbased detergents that may be employed can be, for example, other non-sulfur containing phenates, sulfur containing phenates, salixarates, salicylates, sulfonates and mixtures thereof, or borated equivalents thereof. The overbased detergent may be borated with a borating agent such as boric acid. Overbased detergents are known in the art. In one embodiment the additional overbased detergent may be a sulfonate. The sulfonate detergent may be predominantly a linear alkylbenzene sulfonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The linear alkylbenzene sulfonate detergent may be particularly useful for assisting in improving fuel economy. Typically the overbased detergent may be a calcium or magnesium overbased detergent.

Other Additives

A lubricating composition according to one embodiment of the invention may be prepared by adding to the product described herein optionally other performance additives (as described herein below). The other performance additives include at least one of metal deactivators, viscosity modifiers, further detergents, friction modifiers, antiwear agents, corrosion inhibitors, further dispersants, dispersant viscosity modifiers, extreme pressure agents, further antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes a viscosity modifier. The viscosity modifier is known in the art and may include hydrogenated styrene-butadiene rubbers, olefin copolymers, such as ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the lubricating composition of the invention further comprises a dispersant viscosity modifier. The dispersant viscosity modifier may be present at 0 wt % to 15 wt %, or 0 wt % to 10 wt %, or 0.05 wt % to 5 wt %, or 0.2 wt % to 2 wt % of the lubricating composition.

The lubricating composition may further include dispersants beside the optional succinimide dispersant described above, or mixtures thereof. The dispersant may be a Mannich dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

In one embodiment a friction modifier may be included in the formulation, selected from long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22, or 12 to 20 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylenepolyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester such as, for example, glycerol mono-oleate and in another embodiment the long chain fatty acid ester may be a triglyceride.

The lubricating composition optionally may further include at least one antiwear agent. Examples of suitable antiwear agents include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl)disulfides. The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups may be at least 8. The antiwear agent may in one embodiment include a citrate as is disclosed in US Patent Application 20050198894.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound may be a titanium carboxylate. In one embodiment the titanium (IV) carboxylate may be titanium neodecanoate.

In one embodiment the oil soluble titanium compound may be present in the lubricating composition in an amount necessary to provide for 10 ppm to 1500 ppm titanium by weight or 25 ppm to 150 ppm titanium by weight.

Extreme Pressure (EP) agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), a hydrocarbyl-substituted 2,5-di-mercapto-1,3,4-thiadiazole, or oligomers thereof, organic sulfides and polysulfides such as dibenzyldisulfide, bis-(chlorobenzyl)disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be useful in the compositions of the invention include polysiloxanes, copolymers of ethyl acrylate, and 2-ethylhexyl acrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton-37™ (FN 1380) and Exxon Mineral Seal Oil™ (FN 3200).

Oils of Lubricating Viscosity

One component of the present invention is an oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition. For concentrates, the oil of lubricating viscosity may be present at lower concentration or in a minor amount, for example, from 10 to 50% by weight, and in one embodiment 10 to 30% by weight.

Natural oils useful in making the inventive lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included are alkylene oxide polymers and interpolymers and derivatives thereof, in which the terminal hydroxyl groups may have been modified by esterification or etherification. Also included are esters of dicarboxylic acids with a variety of alcohols, or esters made from $C_5$ to $C_{12}$ monocarboxylic acids and polyols or polyol ethers. Other synthetic oils include siliconbased oils, liquid esters of phosphorus-containing acids, and polymeric tetrahydrofurans. The synthetic oils may be produced by Fischer-Tropsch reactions and typically may comprise hydroisomerized Fischer-Tropsch hydrocarbons and/or waxes, or hydroisomerized slack waxes.

Unrefined, refined and rerefined oils, either natural or synthetic, can be used in the lubricants of the present invention. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation.

In one embodiment, the oil of lubricating viscosity is an API Group II, Group III, Group IV, or Group V oil, including a synthetic oil, or mixtures thereof. These are classifications established by the API Base Oil Interchangeability Guidelines. Both Group II and Group III oils contain ≤0.03 percent sulfur and ≥90 percent saturates. Group II oils have a viscosity index of 80 to 120, and Group III oils have a viscosity index ≥120. Polyalphaolefins are categorized as Group IV. Group V is encompasses "all others" (except for Group I, which contains >0.03% S and/or <90% saturates and has a viscosity index of 80 to 120).

In one embodiment, at least 50% by weight of the oil of lubricating viscosity is a polyalphaolefin (PAO). Typically, the polyalphaolefins are derived from monomers having from 4 to 30, or from 4 to 20, or from 6 to 16 carbon atoms. Examples of useful PAOs include those derived from 1-decene. These PAOs may have a viscosity of 1.5 to 150 $mm^2/s$ (cSt) at 100° C. PAOs are typically hydrogenated materials.

The oils of the present invention can encompass oils of a single viscosity range or a mixture of high viscosity and low viscosity range oils. In one embodiment, the oil exhibits a 100° C. kinematic viscosity of 1 or 2 to 8 or 10 $mm^2/sec$ (cSt). The overall lubricant composition may be formulated using oil and other components such that the viscosity at 100° C. is 1 or 1.5 to 10 or 15 or 20 $mm^2/sec$ and the Brookfield viscosity (ASTM-D-2983) at −40° C. is less than 0.02 or 0.15 mPa-s (20 cP or 15 cP), such as less than 0.1 mPa-s, even 0.05 or less.

Use

The Additive package can be used in lubricating composition with oil of lubricating viscosity to improve at least one of (A) piston deposit, (B) piston cleanliness, (C) soot induced viscosity thickening, and (D) oxidation induced viscosity thickening.

In one embodiment, employing the additive package in a lubricant composition can assist the composition in passing test PSA DV4 for soot induced viscosity thickening and piston cleanliness in a PAS 1 4 liter, 8 valve, 4 cylinder diesel engine. This test is regarded as an industry standard for soot induced viscosity thickening, but also has piston cleanliness parameters.

In another embodiment, employing the additive package in a lubricant composition can assist the composition in passing test VW TDI for piston cleanliness in a 4 cylinder 1.9 liter, 81 kW passenger car diesel engine.

In still another embodiment, employing the additive package in a lubricant composition can assist the composition passing the Sequence MG-test for oxidation induced viscosity thickening and piston cleanliness in a GM 3.8 liter 6 valve gasoline engine.

The additive package can be used in lubricating compositions for variously fueled engines, such as, for example, gasoline, diesel, alcohols, bio-diesel, and hydrogen fueled engines.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1—Formulation for Passing DV4 Test

| Example 1 Materials | Treat Rate in Finished oil (% wt) |
|---|---|
| Oil of lubricating viscosity | 91.65 |
| Corrosion Inhibitor | 0.02 |
| Sulfonate Detergent | 0.88 |
| Phenate Detergent | 1.06 |
| Other Dispersant | 2.43 |
| Anti-wear | 0.68 |
| Sulfur Containing Anti-oxidant | 0.33 |
| Antifoam | 0.007 |
| Alkaryl Amine AO | 1.0 |
| Hindered phenolic AO | 0.5 |
| High-vinylidene polyisobutylene succinimide | 0.438 |
| Conventional polyolefin acylating aromatic amine succinimide | 1.0 |

A sample of example 1 is subjected to an engine test PSA DV4TD (CEC-L-093-04). The test is regarded as an industry standard for soot induced viscosity thickening, and it also has a piston cleanliness parameter. Details of the DV4 engine test are shown below.

CEC Test L-93-04

- PSA 1.4 L, 8 valve, 4 cylinder engine (new engine for every test)
- test duration 120 hours
- 2 stages which are repeated 240 times
- 2.5 minute idle stage followed by 27.5 minute, 4000 RPM stage
- Oil samples taken at 24, 48, 72, 96 and 120 hours The oil samples taken at 24, 48, 72, 96 and 120 hours are analyzed for soot content (via UV—method L-82-97) and viscosity at 100° C. (method CEC L-83). The viscosity of the used oil samples are compared to the fresh oil sample and the absolute viscosity increase is calculated (used oil viscosity—fresh oil sample viscosity).

Acceptance limits for oil in a Peugeot DV4 engine are established for European oil sequences for service fill oils for gasoline and diesel engines, oil specifications ACEA A1/B1, A3/B3, A3/B4, A5/B5, C1, C2, C3 and C4. The pass limit for the viscosity ratio (candidate/reference) is less than 0.6. The piston cleanliness pass limit is greater than the reference result minus 2.5.

| Test - DV4 | Example 1 Results |
|---|---|
| Viscosity at 100 C. ($mm^2$) | 4.9 |
| Piston Cleanliness (MERIT) | 4.1 |
| RL223 Reference Oil Viscosity at 100 C. ($mm^2$) | 9.7 |
| RL223 Reference Oil Piston Cleanliness (MERIT) | 6.2 |
| Viscosity Ratio (Candidate /Reference) PASS LIMIT ≤ 0.6 | 0.51 |
| Piston Cleanliness PASS LIMIT (≥Reference - 2.5 points) | 3.7 |
| Overall Engine Test Conclusion | PASS |

Example 2—Formulation for Passing TDI Test

| Example 2 Materials | Treat Rate in Finished oil (% wt) |
|---|---|
| Oil of lubricating viscosity | 91.00 |
| Corrosion Inhibitor | 0.02 |
| Sulfonate Detergent | 0.88 |
| Phenate Detergent | 1.06 |
| Other Dispersant | 2.43 |
| Anti-wear | 0.68 |
| Sulfur Containing Anti-oxidant | 0.33 |
| Antifoam | 0.007 |
| Alkaryl Amine AO | 1.0 |
| Hindered phenolic AO | 0.5 |
| High-vinylidene polyisobutylene succinimide | 1.095 |
| Conventional polyolefin acylating aromatic amine succinimide | 1.0 |

A sample of example 1 and example 2 are subjected to an engine test VW TDI CEC-L-78-T-99 test, also known as the PV1452 test. The test is regarded as an industry standard and is a severe assessment of a lubricant's performance capabilities. The test employs a 4-cylinder, 1.9 liter, 81 kW passenger car diesel engine, which is a direct injection engine in which a turbocharger system is used to increase the power output of the unit. The industry test procedure consists of a repeating cycle of hot and cold running conditions. This involves a 30 minute idle period at zero load followed by 180 minutes at full load and 4150 rpm. In the standard test, the entire cycle is then repeated for a total of 54 hours. In this 54 hour period the initial oil fill of 4.5 liters of test lubricant is not topped up.

At the end of the 54 hour test, the engine is drained, the engine disassembled and the pistons rated for piston deposits and piston ring sticking. This affords a result which is assessed relative to an industry reference oil (RL206) to define passing or failing performance.

The pistons are rated against what is known as the DIN rating system. The three piston-ring grooves and the two piston lands that lie between the grooves are rated on a merit scale for deposits and given a score out of 100 by a method known to those skilled in the art. In summary, the higher the number the better the performance: 100 indicates totally clean and 0 indicates totally covered with deposit. The five scores are then averaged to give the overall piston cleanliness merit rating. The scores for each of the four pistons are then averaged to afford the overall piston cleanliness for the test.

| Test - VW TDI | Example 1 Results | Example 2 Results |
|---|---|---|
| Piston Cleanliness | 57 | 63 |
| RL206 Reference Oil Piston Cleanliness | 64 | 65 |
| Piston Cleanliness Pass Limit for ACEA A3/B3 (Ref. Oil - 4 points) | 60 | 61 |
| Engine Test Conclusion versus ACEA A3/B3 Pass Limit | Fail | Pass |

Example 3—Formulation for Passing Seq. IIIG

| Example 3 Materials | Treat Rate in Finished oil (% wt) |
|---|---|
| Oil of lubricating viscosity | 89.75 |
| Corrosion Inhibitor | 0.02 |
| Sulfonate Detergent | 0.88 |
| Phenate Detergent | 1.06 |
| Other Dispersant | 2.43 |
| Anti-wear | 0.68 |
| Sulfur Containing Anti-oxidant | 0.33 |
| Antifoam | 0.007 |
| Alkaryl Amine AO | 2.0 |
| Hindered phenolic AO | 0.75 |
| High-vinylidene polyisobutylene succinimide | 1.095 |
| Conventional polyolefin acylating aromatic amine succinimide | 1.0 |

A sample of example 1 and example 2 are subjected to the Sequence IIIG test. The Sequence MG procedure measures oil thickening and piston deposits during high-temperature conditions and provides information about valve train wear. The Sequence MG test is part of engine oil categories: API SN and ILSAC GF-5. The Sequence MG test simulates high-speed service during relatively high ambient conditions.

The Sequence IIIG test uses a 1996/1997 231 CID (3,800 cc) Series II General Motors V-6 fuel-injected gasoline engine. Using unleaded gasoline, the engine runs a 10-minute initial oil-leveling procedure followed by a 15-minute slow ramp up to speed and load conditions. The engine then operates at 125 bhp, 3,600 rpm, and 150° C. oil temperature for 100 hours, interrupted at 20-hour intervals for oil level checks.

At test end, all six pistons are inspected for deposits and varnish, cam lobes and lifters are measured for wear, kinematic viscosity increase (percent increase) at 40° C. is compared to a new oil baseline every 20 hours and wear metals Cu, Pb, and Fe, are evaluated.

| Test - Seq. IIIG | Example 2 Results | Example 3 Results |
|---|---|---|
| Viscosity Increase % | 7900.0 | 134.0 |
| Average Cam + Lifter Wear (μm) | 65.1 | 31 |
| Avg Weighted Piston Deposit (MERIT) | 3.31 | 4.94 |
| Number of Cold-Stuck Rings - Total | 0.0 | 0.0 |
| Viscosity Increase % allowed | 150 | 150 |
| Avg Cam + Lifter Wear allowed (μm) | 60(max) | 60(max) |
| Minimum Avg Weighted Piston Deposit allowed (MERIT) | 4 | 4 |
| Number of Cold-Stuck Rings - Total | none | none |
| Overall Engine Test Conclusion | FAIL | Pass |

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

What is claimed is:

1. A lubricant composition comprising, (a) a dispersant mixture comprising, (i) from about 1 to about 3 wt % of the additive package, on an active basis, of (1) the reaction product of a succinated polyisobutylene with one or more polyethylenepolyamines, wherein the polyisobutylene has an average of between 1.2 and 1.6 succinic acid moieties per polymer, (2) the reaction product of succinated polyisobutylene with one or more aromatic polyamines wherein the polyisobutylene has an average of between 1.2 and 1.6 succinic acid moieties per polymer, or (3) mixtures thereof, wherein the polyisobutylene has an Mn of at least about 1500 daltons and no more than 5,000 daltons, and (ii) from about 1.0 to about 3 wt % of the additive package, on an active basis, of the reaction product of a high-vinylidene polyisobutylene acylating agent and an aliphatic amine, wherein the high-vinylidene polyisobutylene has an Mn of no more than 2500 daltons, and at least 50 mol % of the end groups in the high-vinylidene polyisobutylene from which the polyisobutylene acylating agent is derived are methylvinylidene, and wherein the reaction product has a TBN of about 10 to about 30 on an oil-free basis, and wherein at least 10 mol % but no more than 60 mol % of the nitrogen from the amines in the dispersant mixture is aromatic nitrogen (b) from about 1 to about 6 wt. % of an antioxidant mixture comprising, (i) greater than 1.0 wt % of an ashless diarylamine, and (ii) greater than 0.5 wt % of an ashless phenol compound, and (c) 75 to 95 wt % of an oil of lubricating viscosity wherein the lubricant composition passes the Sequence IIIG test for oxidation induced viscosity thickening and piston cleanliness in a GM 3.8 liter 6 valve gasoline engine.

2. The lubricant composition of claim 1 additionally comprising an over-based phenol-containing detergent.

3. The lubricant composition of claim 1 having a TBN of at least 8 but less than 15.

4. The lubricant composition of claim 1 additionally comprising an olefin copolymer viscosity index improver.

5. The lubricant composition of claim 1, wherein the oil of lubricating viscosity is a group I oil, group III oil, or mixture thereof.

6. The lubricant composition of claim 1, wherein the lubricant composition passes test PSA DV4 for soot induced viscosity thickening and piston cleanliness in a PAS1 4 liter, 8 valve 4 cylinder diesel engine.

7. The lubricant composition of claim 1, wherein the lubricant composition passes test VW TDI for piston cleanliness in a 4 cylinder 1.9 liter, 81 kW passenger car diesel engine.

8. A method of lubricating an engine comprising applying to the engine the lubricating composition as claimed in claim 1.

9. A method for improving at least one of (A) piston deposit, (B) piston cleanliness, (C) soot induced viscosity thickening, and (D) oxidation induced viscosity thickening, in an engine oil comprising including in the engine oil a composition as claimed in claim 1.

* * * * *